United States Patent [19]

Anderson et al.

[11] 4,197,772

[45] Apr. 15, 1980

[54] AUTOMATIC FEEDING APPARATUS FOR PUNCH PRESS

[76] Inventors: Stanley L. Anderson, 445 Heather Heights Rd., Monrovia, Calif. 91016; Donald F. Nettleton, 2043 Glen Springs Rd., Pasadena, Calif. 91107

[21] Appl. No.: 885,374

[22] Filed: Mar. 10, 1978

[51] Int. Cl.[2] ..... B26D 7/06; B26D 7/24; B26F 1/02

[52] U.S. Cl. ..... 83/63; 83/95; 83/154; 83/277; 83/281; 83/411 R; 83/417; 414/27; 414/122; 414/744

[58] Field of Search ..... 83/63, 95, 154, 151, 83/276, 281, 280, 267, 417, 277, 411 R; 408/7; 214/8.5 D, 6 FS, 1 BS, 1 BH, 1 BT; 414/27, 122, 744

[56] References Cited

U.S. PATENT DOCUMENTS

| | | | |
|---|---|---|---|
| 2,881,929 | 4/1959 | Giffen | 214/1 BH |
| 3,409,149 | 11/1968 | Graux | 214/8.5 D |
| 3,601,264 | 8/1971 | Ritter, Jr. | 214/1 BH |
| 3,786,976 | 1/1974 | Murphy | 83/63 X |
| 3,830,121 | 8/1974 | Makeev et al. | 83/281 X |
| 3,885,678 | 5/1975 | Borg et al. | 214/1 BT X |
| 4,046,040 | 9/1977 | Bourdo | 83/63 |

FOREIGN PATENT DOCUMENTS

| | | | |
|---|---|---|---|
| 47-20679 | of 1972 | Japan | 83/63 |

*Primary Examiner*—Frank T. Yost
*Attorney, Agent, or Firm*—Christie, Parker & Hale

[57] ABSTRACT

An auxiliary feeder apparatus for a punch press. The feeder picks up blank stock to be punched, transfers it to a work holding collet where the press punches a circular pattern of spaced holes or slots in the blank to form an electric motor lamination or the like. After punching, the feeder apparatus picks up the finished part and transfers it to a storage location while at the same time picking up and transferring a new blank to the collet for punching. The operation of the feeder apparatus is integrated with the operation of the punch press and is fully automatic. Controls in the feeder apparatus and press prevent the punch from operating when malfunctions, such as a part not properly positioned on the collet or two or more parts transferred to the collet, occur.

9 Claims, 4 Drawing Figures

AUTOMATIC FEEDING APPARATUS FOR PUNCH PRESS

DESCRIPTION OF THE PRIOR ART

The present invention relates to a punch press and, in particular, to an automatic feeding mechanism for use with a punch press.

In the operation of punch presses such as those described in U.S. Pat. No. 3,164,049, the transfer of blank stock to be machined from a supply point to the collet for holding the workpiece was accomplished by a manual transfer of parts. Removal of finished parts was likewise done manually. The speed of operation of the press was thereby limited by the manual dexterity and speed of the operator placing and removing the parts to be machined. In addition, the requirement for an operator to be in attendance at each punch press meant a significant labor expense attendant upon the operation of the machine.

In addition to the limited speed of operation and the labor involved, the manual operation of such a press also inevitably involved a safety factor. An operator transferring parts to and from the collet at the work station was required to physically grasp parts and coordinate the punching cycle of the press with his manual movements such that there was a smooth flow of parts to and from the work station. Operators of machine tools of this type, despite efforts to observe safe practices, were inevitably faced with situations in which they reached into the work area of a machine during its operation and often experienced injuries when their hands, arms, or articles of clothing were caught or entangled in the machinery. In addition, the manual operation of such a machine was typically quite monotonous, tending to lull the operator and tire him quickly. In such an event, the efficiency of the operation of the press declined and safe operation was significantly reduced.

SUMMARY OF THE PRESENT INVENTION

To remedy the foregoing, an automatic feeding apparatus for transferring large numbers of parts on a one-by-one basis from a supply position to a workstation of a machine tool and for removing parts which have been machined from the workstation to a storage position is provided. Utilizing the feeding mechanism, the operation of the punch press is rendered continuous and fully automatic without the need of requirement of the attendance of an operator thereby enabling one operator to be responsible for and to adequately supervise the operation of a plurality of such machine tools, typically four or more.

The present invention provides an automatic feeding apparatus for transferring workpieces to and from a workstation of a machine tool comprising a supply station for workpieces and a workpiece pickup arm operatively associated with the supply station. A first transfer arm is provided for transporting a workpiece from the pickup arm to the work station. A second transfer arm for transporting the workpiece from the workstation to a storage station is provided as are means for removing the workpiece from the second arm and depositing it at the storage station.

As a feeding apparatus for a punch press, the present invention greatly enhances the efficiency and productivity of the punch press and likewise results in an operation which is substantially safer than when the machine is operated manually. The feeder is adaptable for use with parts of varying sizes and is capable of picking up and transferring parts to the workstation for punching and from the workstation to a storage spindle, regardless of the configuration of cut-outs, slots and punchings which are produced by the press in the course of working on a specific type of part.

In the typical operation of a punch press according to the present invention, a die set is chosen for operating on a part of a specific size and for producing cut-outs of a specific configuration. A plurality of blank stock parts are mounted or stacked on a first storage or supply spindle (the storage station) preparatory to feeding the blank parts into the punch press. Typically, hundreds of blank parts are stored on the supply spindle. The die set is installed on the press and operation is initiated. The workpieces are lifted off the stack individually by a pickup arm and transferred by a first transfer arm of the transfer assembly from the pickup arm to a press collet or chuck where the part is gripped and held during punching. Upon completion of one full cycle of punch press operation, the collet releases and a second transfer arm on the transfer assembly picks up the finished part and transfers it to a storage spindle. At the same time, a new part is deposited at the collet. The operation of the machine tool is fully automatic for the time period necessary to transfer all of the blank parts through the workstation to the storage spindle.

DESCRIPTION OF THE DRAWINGS

These and other advantages of the present invention will be better understood by reference to the figures of the drawing wherein.

DESCRIPTION OF A SPECIFIC EMBODIMENT

Figure 1:
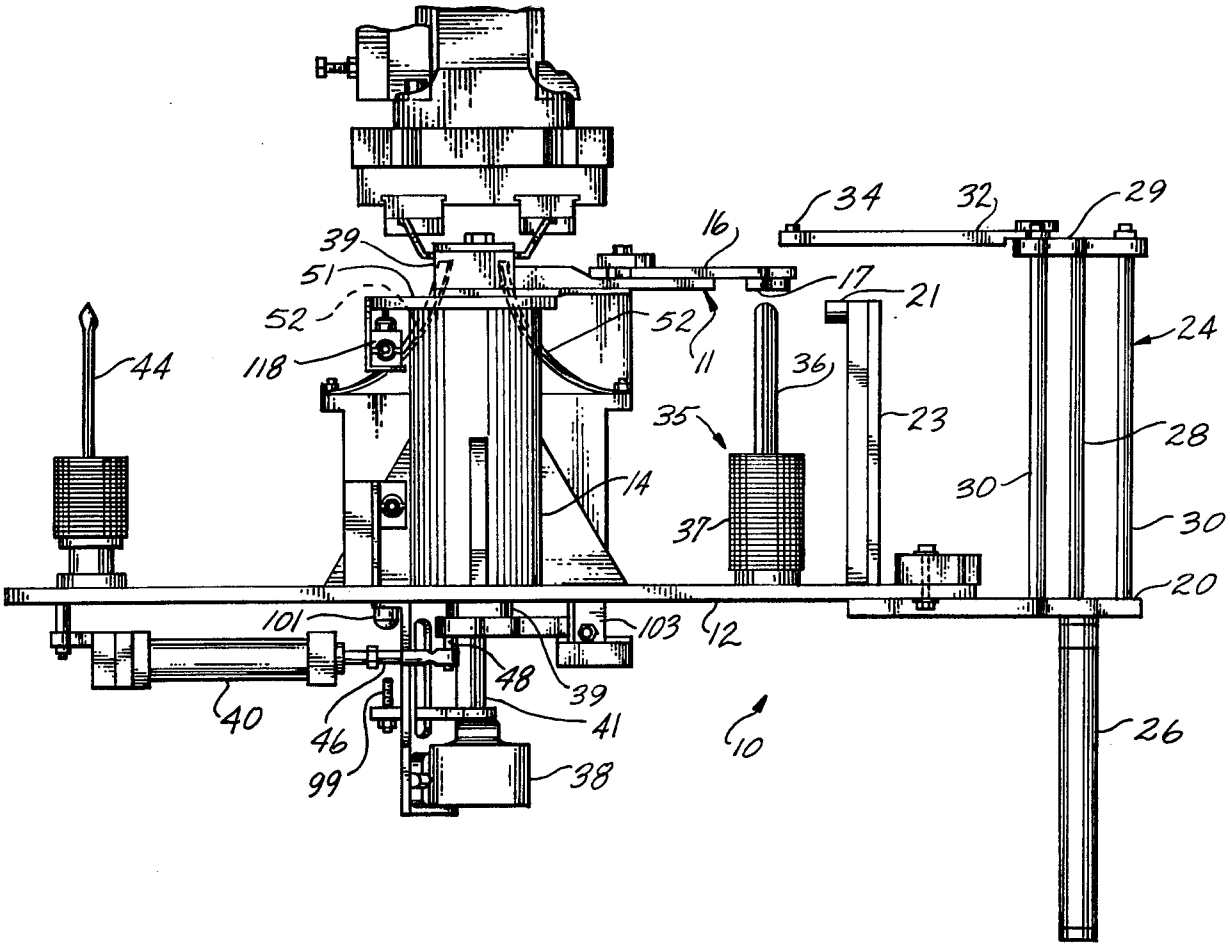
FIG. 1 is a front elevation view of the feeder apparatus with the part transfer mechanism positioned to pick up a new part to be machined.
Figure 2:
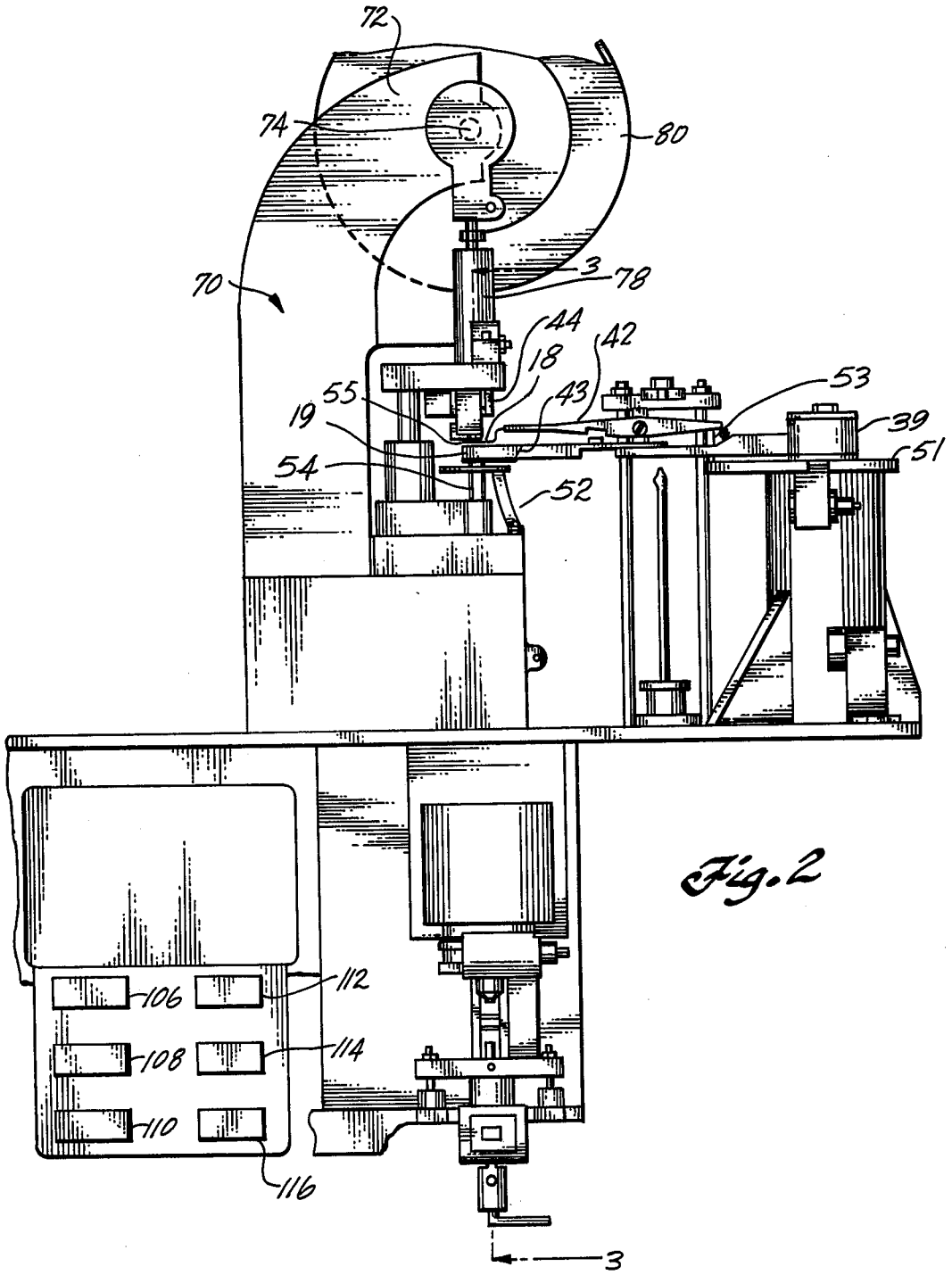
FIG. 2 is a side elevation view of the punch press and feeder apparatus.
Figure 4:
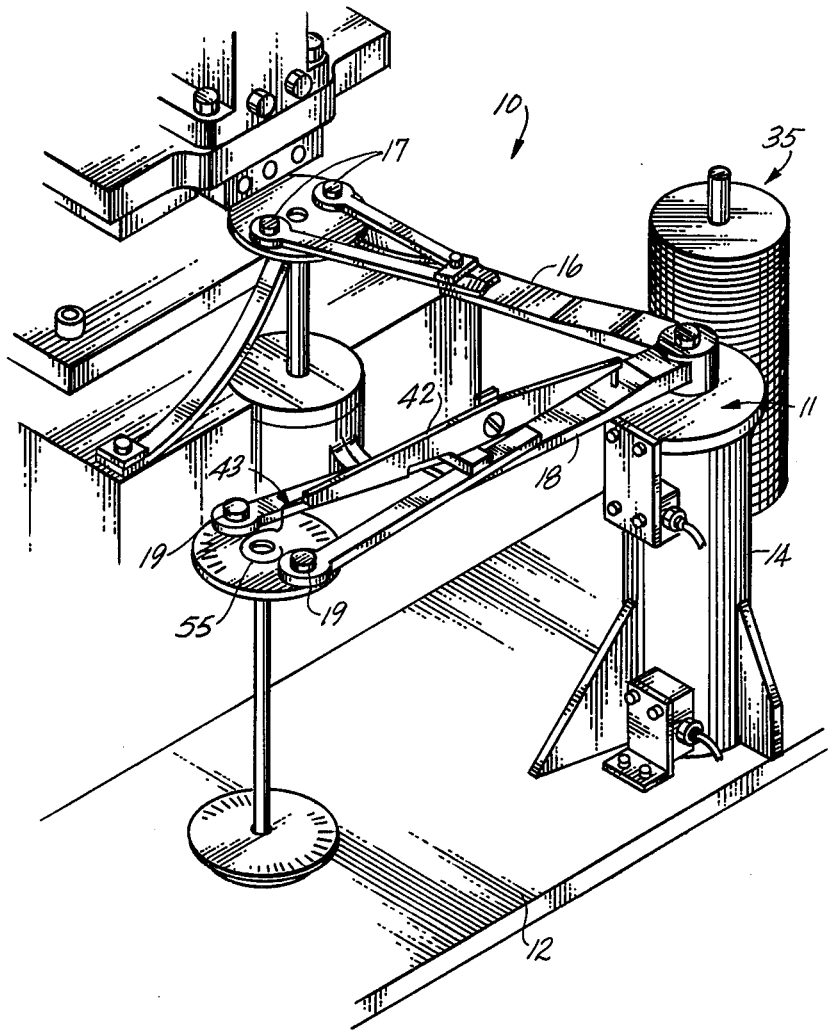
FIG. 4 is a perspective view of the transfer assembly with the first transfer arm positioned at the collet and the second transfer arm positioned at the storage spindle.

The feeder apparatus 10 of the present invention, as shown in FIGS. 1, 2 and 4, includes a horizontal bench plate 12 on which is mounted a transfer arm assembly 11. Assembly 11 comprises a column 14 which supports a rotatable shaft upon which is mounted a first transfer arm 16 and a second transfer arm 18 angularly spaced from arm 16 by approximatey 60°. Secured to the free ends of each of the transfer arms are pairs of permanent magnets 17,19, respectively, for holding and transferring work pieces between supply, storage and work positions on the punch press.

An auxiliary horizontal bench plate 20 is secured to the bench plate at one side thereof for supporting a workpiece pickup apparatus 24. Pickup apparatus 24 includes an air cylinder 26, a shaft 28 driven by the air cylinder, three vertical guides 30, an upper platform 29 and a pickup arm 32 connected to platform 29. The pickup arm 32 also has a pair of permanent magnets 34 secured to its free end for picking up blank parts from a supply source 35 and holding said parts until they are picked up by the first transfer arm 16. In the embodiment shown in FIG. 1, the supply source is a vertical spindle 36 on which has been loaded a number of centrally apertured blank parts 37 to be machined by the punch press.

Under control of the sequencing elements of the punch press, air cylinder 26 lowers the shaft 28 and the pickup arm 32 to the top of the stack of blank parts on the supply spindle. The magnets 34 pick up the topmost part and raise it to a predetermined elevation above the top of the spindle for transfer to the transfer arm 16. The vertical position of magnets 17 within receiving sockets on arm 16 is adjustable to cause only enough magnetic pickup force to be exerted to to hold one part at a time. Before the pickup arm 32 rises, transfer arm 16 has swung into position above the stack of workpieces with its magnets 17 positioned above the half of the workpiece nearest the transfer arm assembly. The magnets 34 of the pickup arm are positioned over the opposite half. As arm 32 ascends and raises a blank part, it is seized by magnets 17 as arm 32 passes the elevation of arm 16 and continues to the predetermined height of its rise. Transfer arm 16 then swings to the workstation to deposit the part on the die collet. To ensure the transfer of one part at a time from pickup arm 32 to first transfer arm 16, an auxiliary magnet 21, mounted on a supporting shaft 23, is positioned close to the edge of the workpieces at the point of transfer of a part from pickup arm to transfer arm. The field of magnet 21 exerts a force sufficient to strip off a second part which may have accidentally been picked up by arm 32 and cause it to drop back onto spindle 36.

The transfer arm assembly includes, in addition to the column 14 and first and second transfer arms 16,18, a vertical air cylinder 38, a horizontal air cylinder 40, and a shaft 41 driven by cylinder 38. Transfer arm 18 has an auxiliary part-stripping arm 42 mounted on it for removing machined parts from the transfer arm and stacking them on a storage or take-up spindle 44. The actual stripper element is a wire 43 having a horizontal loop 55 formed at its free end. The wire is secured at its opposite end to the free end of arm 42. When the end of arm 42, to which wire 43 is attached is tilted downwardly, the loop exerts pressure on a part held by the magnets 19 of arm 18 overcoming the magnetic force and causes the part to be dropped onto spindle 44.

Vertical cylinder 38 raises and lowers shaft 41 and the transfer arms mounted thereon at predetermined intervals in the sequence of operation for effecting transfer of parts from transfer arm 16 to a chuck (die collet) 54 of the punch press and stripping of parts from transfer arm 18 onto storage spindle 44. A drive shaft 46 extending from cylinder 40 connects with a pin 48 extending downwardly from the base of column 39 to produce rotation of column 39 and movement of transfer arms 16,18 through their respective arcs of rotation.

A pair of leaf springs 52 bracket the chuck (die collet) 54 of the punch press and act as spring-loaded stripping elements for raising a finished part from the chuck after the punching operation has been completed and the chuck has released. When lifted by leaf springs 52, the part is again seized by the magnets 19 of arm 18. Thereafter, the transfer arm assembly rotates arm 18 to position the finished part over spindle 44 and arm 16 has a part positioned over collet 54. The rotation of column 39 causes a control surface on column 39 to contact a microswitch, operating cylinder 38 and causing the transfer arm assembly to drop until it is in contact with plate 51. If transfer arm assembly 11 does not fully seat on plate 51, due to dirt or other contamination on the two facing surfaces of the plate 51 and undersurface of assembly 11 or because two parts are on the collet, punch press operation stops until the problem is cleared. As assembly 11 seats on plate 51, pin 53 engages plate 51 causing arm 42 to tilt forward and loop 55 to strip the finished part from arm 18 onto spindle 44. At the same time, a new part to be machined is deposited on and seized by the collet 54 from transfer arm 16.

Figure 3:
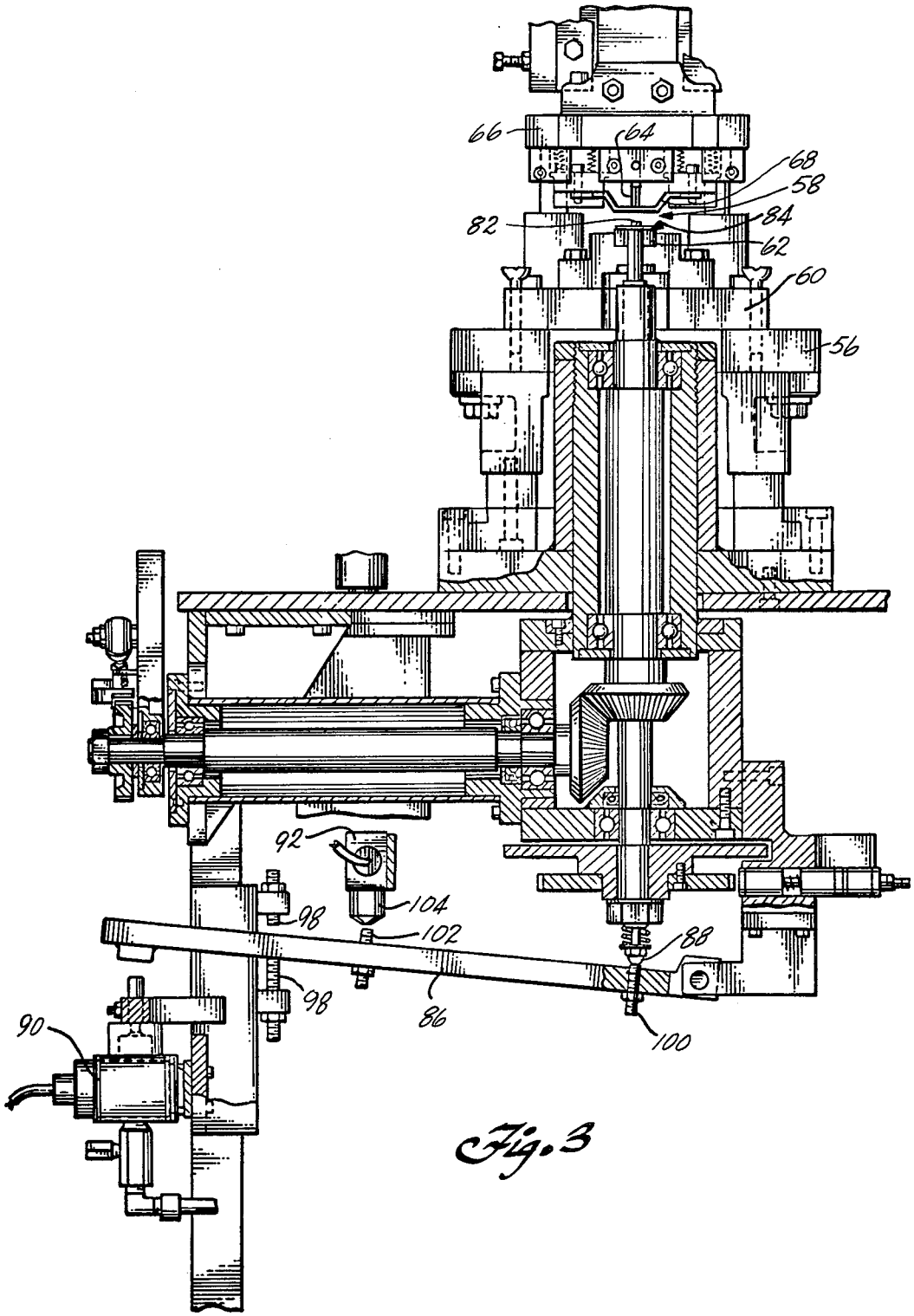
FIG. 3 is an elevation view taken along lines 3—3 of FIG. 2 illustrating the press and feeder mechanism controls whereby the pickup and transfer elements of the feeder apparatus are operated to rotate and index the workpieces at the collet.

As in the punch press of U.S. Pat. No. 3,164,049, the punch press frame 70 supports a die plate 56 (FIG. 3) which in turn supports a die set 58. The die set includes a lower mounting plate 60 on which is mounted a die plate 62 having a die cavity therein which coooperates with a punch 64 carried by the punch plate 66. A stripper 68 is also carried by the punch plate 66.

The punch press frame 70 includes an upper portion 72 which overhangs the die set 58 and is provided with a drive shaft 74 having an eccentric which reciprocates a ram 78. The drive shaft 74 is provided with a fly wheel 80 driven by a motor (not shown). An expandable collet 84 is utilized for the purpose of holding a workpiece to be punched by the press. The collet is expanded outwardly to grip and hold the work piece.

The sequencing controls of the punch press are also utilized to control the operations of the pickup arm and transfer arm assembly. A lever 86 engages a cap nut 88 and, when raised, lifts a downwardly tapering, expanding head 82 to permit retraction of the collet. The extended end of the lever 86 engages an air cylinder 90. The air cylinder 90 is controlled by a cam-operated switch 92. A single lug is provided on the cam-operated switch 92 so that the collet will be released after each revolution of the collet and its workpiece.

Adjustable stops 98 are provided to limit the movement of lever 86 and an adjustment screw 100 may be carried by the lever 86 and located under the cap nut 88. Also carried by the lever 86 is a second adjustment screw 102 which engages a cycle or program terminating switch 104 electrically connected in a suitable manner to terminate operation of the punch press when the collet has completed one revolution.

In operation, the auxiliary feeder mechanism operates as follows. In the automatic mode, the first valve 106 of six air valves operates causing the shaft 41 to rise in column 14 under drive from cylinder 38. Adjustment screw 99 contacts switch 101 at the height of rise of shaft 41 in column 39 causing a second air valve 108 to close, operating cylinder 40, causing the transfer arm 16 to swing to the right and stop at a position above the stack of blank parts to be punched. At the same time, transfer arm 18 is positioned above collet 54. As the punch press completes its rotation and the collet releases the workpiece, springs 52 strip the finished part upwardly off the chuck where it is seized by the magnets 19 on arm 18.

A third air valve 110 operates activating the pickup arm 32 and causing the pickup arm to rise, lifting a part off the stack by means of the magnets 34. The pickup arm continues to rise until the transfer arm magnets 17 are encountered and the part is transferred while the pickup arm continues to rise to a position slightly above the height of the transfer arm. A fourth air valve 112 operates, retracting the piston of cylinder 40, causing column 39 to rotate, moving transfer arms 16 and 18 to the left and bringing the blank part held by transfer arm 16 into position above the collet and the finished part into registration above spindle 44. At the full extent of the arc of rotation to the left, the column 39 operates a pair of switches on support 103. As the first switch closes, valve 114 is operated, causing shaft 41 to drop, placing the unfinished part in position on the collet.

As shaft 41 drops, pin 53 bears against plate 51 tilting arm 42 forward and causing loop 55 to exert pressure on the finished part to strip the part from magnets 19 onto spindle 44. As the second switch closes, valve 116 is operated causing the pickup arm 32 to descend until it comes in contact with the next part to be machined on the supply spindle. At the same time, the lever 86 moves downwardly causing the collet to expand and seize the part and thereafter the punch press goes into operation. When shaft 41 drops, if assembly 11 fully seats on plate 51, a detector switch 118 is operated which turns the press on and activates valve 106 to cause the transfer arm to rise and swing back to the pickup position. This places transfer arm 18 in position over the part being machined by the press.

At the end of the punch press cycle, cam-operated switch 92 is activated, causing air cylinder 90 to operate, causing lever 86 to rise, releasing the collet and causing it to open. At the same time, lever 86 operates switch 104, terminating operation of the punch press. The leaf springs 52 then lift the part off of the collet and cause it to be seized by the permanent magnets on transfer arm 18. The next cycle of operation of the transfer mechanism then begins with the transfer arm swinging to the left, transferring a blank part to the collet and a finished part to the storage spindle.

What is claimed is:

1. An automatic feeding apparatus for transferring workpieces to and from a workstation of a machine tool comprising:

a supply station for workpieces;

a workpiece pick-up arm operatively associated with the supply station;

a first transfer arm for transporting a workpiece from the pick-up arm to the workstation;

a second transfer arm for transporting the workpiece from the workstation to a storage station and means for removing the workpiece from the second arm and depositing the workpiece at the storage station;

an expandable collet located at the workstation for receiving workpieces from the first transfer arm;

spring means located adjacent the collet for stripping a finished workpiece from the expandable collet;

first switch means for sensing the proper position of the transfer arm at the workstation and for controlling the operation of the machine tool responsive to said first switch sensing means; and detector switch means mounted below the expandable collet and operatively linked to the transfer arm and workstation for sensing the presence of more than one workpiece at the workstation and for preventing the operation of the machine tool when more than one workpiece is present.

2. An apparatus according to claim 1 including magnetic holding means incorporated into the pickup, first and second transfer arms for attracting and holding metallic workpieces.

3. An apparatus according to claim 2 wherein the pickup arm is vertically movable between the supply station and a predetermined elevation above the first transfer arm.

4. An apparatus according to claim 3 wherein the first transfer arm is movable horizontally between a position in operative relation to the pickup arm and the workstation.

5. An apparatus according to claim 4 including means for transferring a workpiece from the pickup arm to the first transfer arm.

6. An apparatus according to claim 2 including means mounted on the second transfer arm for stripping finished workpieces from the magnetic holding means to the storage station.

7. An apparatus according to claim 6 wherein the supply station and storage station are spindles for receiving centrally apertured workpieces.

8. An apparatus according to claim 2 wherein the magnetic holding means on the first transfer arm are adjustable to adjust the amount of pickup force exerted by the holding means.

9. An apparatus according to claim 1 including magnetic means positioned adjacent the point of transfer between the pickup arm and first transfer arm for preventing transfer of more than one workpiece from the pickup arm to the first transfer arm.

* * * * *